United States Patent [19]

Roach et al.

[11] Patent Number: 5,065,796

[45] Date of Patent: Nov. 19, 1991

[54] LOOM TEMPLE CONTROL SYSTEM TO VARY PICK DENSITY

[75] Inventors: Ernest F. Roach, Eden; Stephen D. Frick; Randell F. Sample, both of Greensboro, all of N.C.

[73] Assignee: Draper Corporation, Greensboro, N.C.

[21] Appl. No.: 591,774

[22] Filed: Oct. 2, 1990

[51] Int. Cl.[5] ..... D03J 1/22

[52] U.S. Cl. ..... 139/300; 139/1 R; 139/110; 139/292; 139/435.2

[58] Field of Search ..... 139/291 R, 292, 300, 139/1 R, 110, 435.2; 112/320, 121.27, DIG. 3, 130, 239, 312, 322, 311, 129; 74/106, 520

[56] References Cited

U.S. PATENT DOCUMENTS 3,943,978 10/1976 Jindra .
3,943,979 10/1976 Porter .
4,048,004 9/1977 Watkins ..... 74/520 X
4,910,837 3/1990 Fujimoto et al. ..... 139/1 R

*Primary Examiner*—Andrew M. Falik
*Attorney, Agent, or Firm*—Rhoades, Coats & Bennett

[57] ABSTRACT

An apparatus for controlling an air jet loom and, in particular, for controlling a loom used for weaving cloth having move than one pick range. One use of such cloth is for tire-cord fabric having a body portion having between 1 and 3.5 ppi and at least one tab portion having between 3.5 and 50 ppi. The system includes an automatic temple insertion device. The system further includes dual nozzles to automatically switches from tab to body; automatic pick spacing change from tab to body; and an automatic tension level control. The system permits multiple tabs on a roll for separating multiple body portions of the roll, providing an inspection segment per roll, and providing a cut line either by "no picks" or by changing the filling within the tab.

18 Claims, 4 Drawing Sheets

LOOM TEMPLE CONTROL SYSTEM TO VARY PICK DENSITY

BACKGROUND OF THE INVENTION (1) Field of the Invention

The present invention relates generally to air jet looms and, more particularly, to a system for automatically controlling an air jet loom used for weaving cloth having more than one pick range, such as tire-cord fabric.

(2) Description of the Prior Art

Tire-cord fabric includes a body portion having between 1 and 3.5 picks per inch (ppi) and a tab portion at each end of the body portion having between 3.5 and 50 ppi. The tab portion is used to stabilize the ends of the body portion of the cloth and to permit separation of the cloth into smaller batches. Because of the differences in pick density between the body portion and tab portions, it is necessary that temples be inserted to stretch the fabric when the tab portion is woven to keep the fabric at its correct width. Conventional temples are set at the fell of the cloth so that the warp and the filling in the weaving will interface at right angles to form the proper fabric width.

One such device is the so-called "Lupton" temples wherein a web is wrapped around a rotatable cylindrical rod, which is located in a tubular bar, the web entering and going out of the interior of the hollow bar through a slot as it is fed. This type of temple can be set very close to the fell of the cloth because of their small cross-section and because they extend over the entire weaving width and they favor a uniform interlacing of the filling yarn.

U.S. Pat. No. 3,943,979, issued to Porter, provides an improvement over the "Lupton" temples in a construction which is effective to improve the stretching effect of such temples. The ends of the cylindrical rod are designed as tubular portions having a plurality of circumferentially spaced longitudinal keyways which extend through the wall of the tubular portion. Longitudinal keys are provided in the keyways with needle points which project at least approximately radially to the outside and are placed and guided in each of the keyways for the positive longitudinal displacement. Advantageously, the longitudinal motion of the keys is obtained by guiding their end portions in an oblique annular grove which is provided in a guide body connected to the hollow bar and secured in a stationary position against rotation. In addition, a radial piercing of the selvage zone by the needle points during rotation of the rod to produce an anchorage of the web to the keys is obtained by providing a bolt which extends parallel to, and eccentrically of, the rod in each of the tubular end portions of the rod and is fixed in the guide body. The bolt extends through a bore of the guide body in which it is fixed, and the longitudinal keys bear against its circumferential surface. The rod is mounted for turning eccentrically relatively to the bolt so that, with its continuous turning, the longitudinally displaceable keys are moved with their needle points into and out of the longitudinal keyways over at least a part of the peripheral ranges which are enveloped by the web. However, like conventional "Lupton" temples, these temples can not be automatically inserted and removed.

U.S. Pat. No. 3,943,978, issued to Jindra, discloses a method and apparatus for lateral tensioning or holding knitted fabrics at a predetermined width. A portion of the fabric adjacent to the edge is formed having uncovered weft threads. The uncovered weft threads are engaged and deflected from above and below by means of a lever which penetrates between the uncovered weft threads so that the strip bears against the side of the which acts as a temple. However, the temple device is continuously in engagement with the fabric and can not be automatically inserted and removed.

Another known type of temple with a good stretching effect is a so-called spike-disc temple, which is equipped with needle points which are manually actuated to stick into the selvage. Such temples are bulky so that they cannot be mounted close to the fell of the cloth, as is the case with the known "Lupton" temples, however, they may be easily engaged and disengaged by hand through use of a wrench.

However, because conventional temples are manually operable only, none of these temples are adaptable for use with modern control systems which can be programed to execute multiple operations in a specific sequence. Without a means for automatically inserting and removing temples it is impossible to develop a loom control system for automatically controlling, without the need for operator intervention, an air jet loom for use in weaving cloth having more than one pick range, such as tire-cord fabric.

Thus, there remains a need for an automatic temple insertion device for use with a new and improved air jet loom control system which is operable to insert multiple tabs on a roll for separating multiple body portions of the roll, providing an inspection segment per roll, and/or providing a cut line either by "no picks" or by changing the filling used within the tab.

SUMMARY OF THE INVENTION

The present invention is directed to a system for controlling an air jet loom and, in particular, for controlling a loom used for weaving cloth having move than one pick range, such as for cloth used for tire-cord fabric. Tire-cord fabric includes a body portion having between 1 and 3.5 ppi and at least one tab portion having between 3.5 and 50 ppi. The tab portions are used to stabilize the ends of the body portion of the cloth and to permit separation of the cloth into smaller batches.

The control system includes an automatic temple insertion device. The system further includes dual nozzles to automatically switch from tab to body; automatic pick spacing change from tab to body; and an automatic dual warp yarn tension level control. The system permits multiple tabs on a roll for separating multiple body portions of the roll, providing an inspection segment per roll, and/or providing a cut line either by "no picks" or by changing the filling within the tab.

In the preferred embodiment, the automatic temple insertion device includes a bi-stable linkage which is attached to an air cylinder and is operable to move the temple from a first inoperable position to a second operable position whereby the temple contacts the fabric. The automatic temple insertion device, in combination with the dual nozzles and automatic pick spacing and warp yarn tension change, permits an operator to preprogram an entire creel and have the loom operate without further operator intervention.

Accordingly, one aspect of the present invention is to provide an apparatus for a power loom for automatically varying the pick density of a woven fabric produced by the loom between a first density value to a second, substantially different density value. The apparatus includes: means associated with the loom for supplying a fill yarn suitable for forming the portion of the woven fabric corresponding to the first density value; means associated with the loom for adjusting the pick density of the woven fabric; temple means for holding the woven fabric at a predetermined width, the temple means being selectively operable between a first position out of engagement with the woven fabric and a second position in engagement with the woven fabric; and control means connected to the first and second means for supplying fill yarn, the means associated with the loom, and the temple means, the control means being operable to selectively engage the temple means and permit the loom to vary the pick density of the woven fabric while maintaining the woven fabric at a predetermined width without operator intervention.

Another aspect of the present invention is to provide an apparatus for automatically inserting a temple for holding woven fabric in a loom at a predetermined width. The apparatus includes: a support plate attached to one side of the loom adjacent to the edge of the woven fabric; a bracket pivotally attached at one end to the support plate and attached to the temple at the other end; and actuator means attached at one end to the support plate and at the other end to the bracket, whereby the temple is selectively operable between a first position out of engagement with the woven fabric and a second position in engagement with the woven fabric.

Still another aspect of the present invention is to provide a weaving apparatus for automatically forming intermediate tabby sections in a continuous length of woven fabric on a power loom. The apparatus includes: first means associated with the loom for supplying a fill yarn having a first predetermined denier value; second means associated with the loom for supplying a fill yarn having a second predetermined denier value; take-up roll means associated with the loom for adjusting the pick density of the woven fabric; temple means for holding the woven fabric at a predetermined width, the temple means including (i) a support plate attached to one side of the loom adjacent to the edge of the woven fabric; (ii) a bracket pivotally attached at one end to the support plate and attached to the temple at the other end; and (iii) actuator means attached at one end to the support plate and at the other end to the bracket, the temple means being selectively operable between a first position out of engagement with the woven fabric and a second position in engagement with the woven fabric; and control means connected to the first and second means for supplying fill yarn, the take-up roll means, and the temple means, the control means being operable to selectively engage the temple means and permit the loom to vary the pick density of the woven fabric while maintaining the woven fabric at a predetermined width without operator intervention.

These and other aspects of the present invention will become apparent to those skilled in the art after a reading of the following description of the preferred embodiment when considered with the drawings.

DESCRIPTION OF THE PREFERRED EMBODIMENTS

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
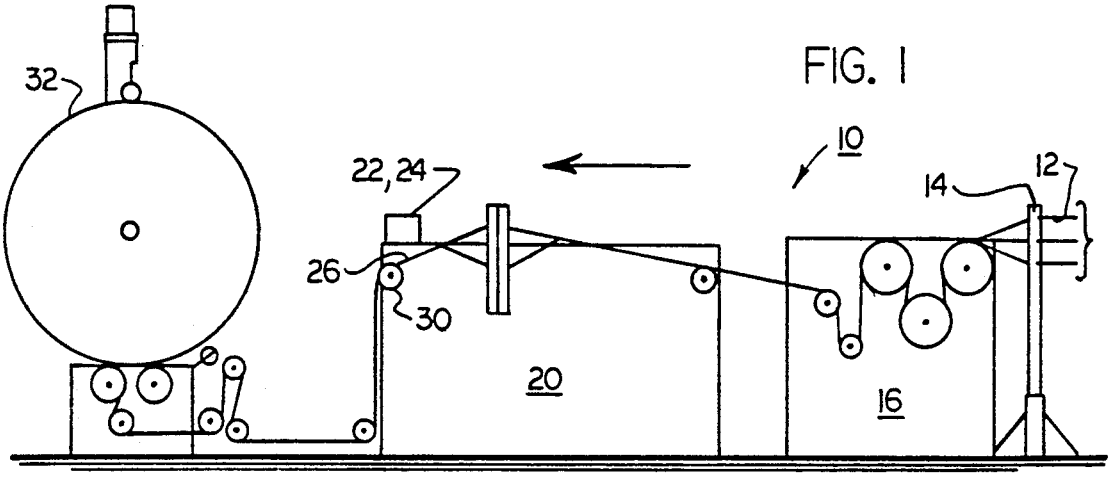
FIG. 1 is a side elevational view of a loom for weaving tire-cord fabric employing a control system constructed according to the present invention, the view being generally diagrammatic.

Referring now to the drawings in general and FIG. 1 in particular, it will be understood that the illustrations are for the purpose of describing a preferred embodiment of the invention and are not intended to limit the invention thereto. As best seen in FIG. 1, an air jet loom for weaving tire-cord fabric, generally designated 10, is shown constructed according to the present invention.

By way of background, an entire creel may provide enough yarn to weave approximately 12,000 yards of tire cord fabric. However, typically it is desirable to separate the fabric into rolls to between 1,000 and 4,000 yards. Furthermore, it is also desirable to furnish at least a small sample of about 6 yards of tire cord fabric for inspection purposes. Accordingly, it is necessary that segments of 1,000 to 4,000 yards of tire cord fabric be separated from one another in some manner that stabilizes the loosely woven fabric.

It is known in the prior art to have an operator manually insert a tabby at the beginning and intermediate between each adjacent length of woven fabric and to weave a higher density portion of fabric to separate the adjacent loosely woven fabrics sections. These tabs are approximately 9" wide and extend across the full width of the woven material and provide a point where fabric may be cut to separate adjacent rolls of material without causing damage to the loosely woven fabric portion.

The Air Jet Tire Cord Weaving System 10 receives yarn supply 12 from a conventional warp creel (not shown). The ends of the yarn pass through an eye board 14 and through a constant tension compensator 16. One example of such a compensator is shown in U.S. Pat. No. 4,216,804, issued to Alexander et al., the entire disclosure of which is hereby incorporated by reference. After exiting the constant tension compensator 16, the yarn supply 12 is received by air jet weaving machine 20. The air jet weaving machine 20 is a conventional design. One machine which is particularly suitable for use in this system is a model J-4400 air jet weaving machine constructed by Draper Corporation, Greensboro, N.C.

As the fabric 26 leaves the loom 20 it is engaged or disengaged by a pair of automatic temple insertion devices 22, 24. The structure and function of the automatic temple insertion devices will be discussed in more detail later. Fabric 26 exits the loom 20 and is received by powered doff mechanism 32. One doff mechanism which is particularly suitable is shown in U.S. Pat. No. 4,203,563, issued to Alexander et al., the entire disclosure of which is hereby incorporated by reference.

Figure 2:
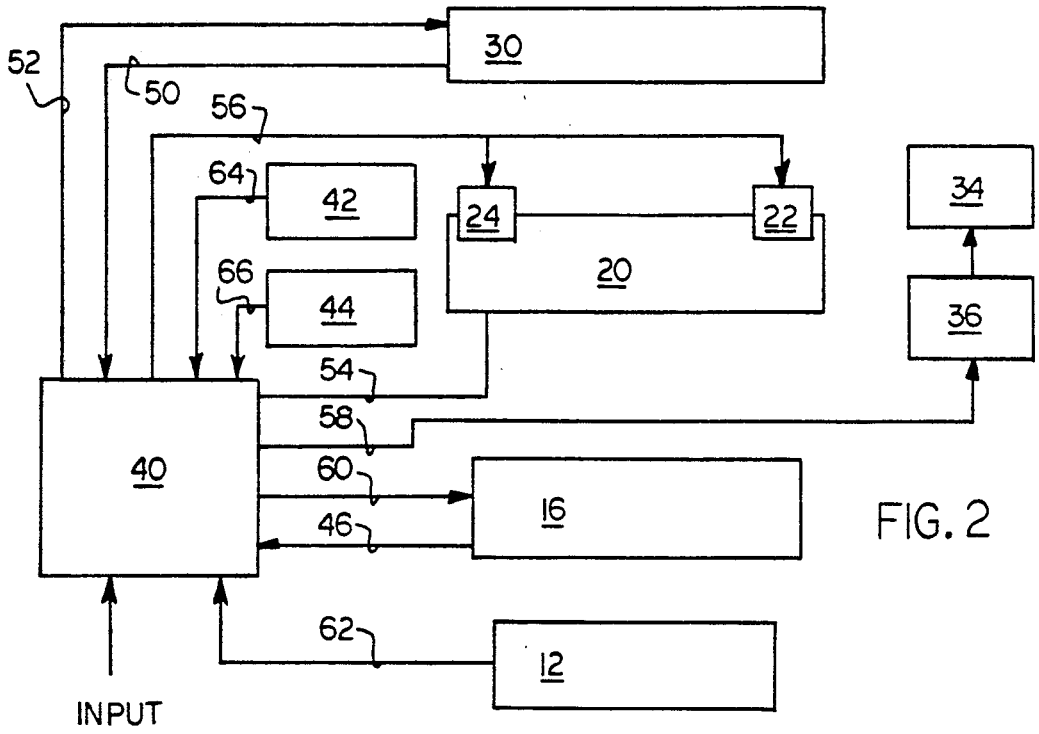
FIG. 2 is a block diagram illustrating the air jet loom control system for the loom shown in FIG. 1.

As best seen in FIG. 2, there is illustrated a block diagram of the air jet loom control system for the loom 20 shown in FIG. 1. In the preferred embodiment, the loom control system 10 includes dual feeders 34 and duel air jets 36. Each of these components are connected to a programmable logic controller (PLC) 40. One type of controller 40 which has been particularly suitable an Omron Model S6 with two relay output modules. In addition, a selvage detector 42 and filling detector 44 also may be connected to the loom 20. Filling detectors are in themselves conventional and well known to the prior art. The selvage detector 42 operates by detecting the presence of the spread out of the woven fabric which occurs due to a tucking failure.

The compressor 16 provides a control signal 46 representative of the amount of yardage passing through the loom 20. Similarly, the take-up roll 30 provide a control signal 50 representative of motor speed to PLC 40. At the same time, feedback circuit 52 from the PLC 40 alerts the take-up roll 30 that the motor speed is correct. Finally, a feedback circuit 54 from the PLC 40 informs the air jet loom 20 when the correct speed is reached.

The PLC 40 provides an on/off control signal to automatic temple actuators 22 and 24 located on opposite sides of the air jet loom 20. The PLC 40 also provides a signal 60 equal to the desired tension to the warp yarn to compressor 16. Yarn supply 12 may include a stop motion signal 62 to controller to halt its operation. Similarly, selvage detector 42 and filling detector 44 may also provide stop motion detection signals 64, 66, respectively, for the same purpose.

Figure 3:
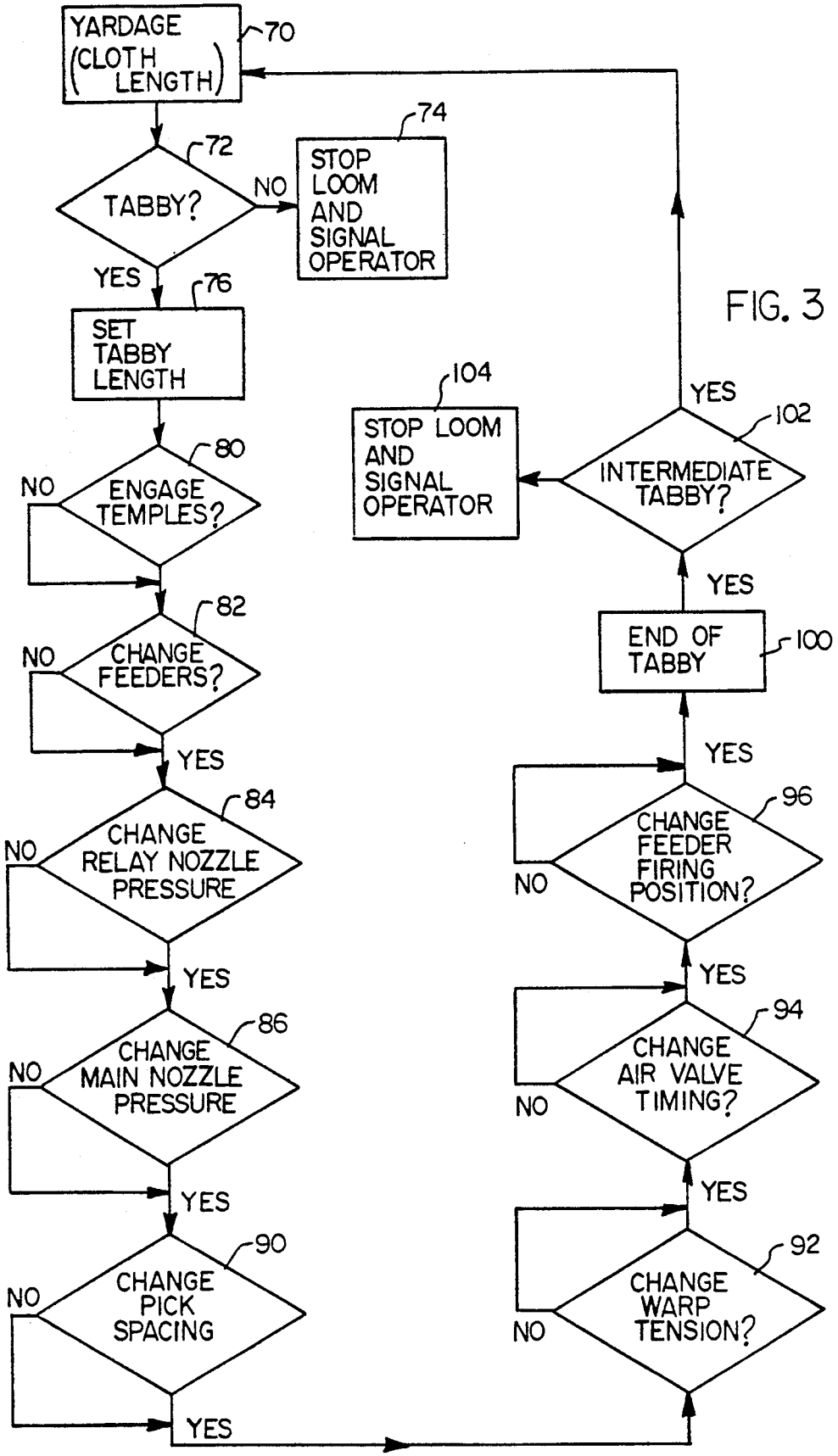
FIG. 3 is a flow chart showing the interrelationship between and the functional operations of the logic controller, temples, feeders, nozzle pressure, take-up speed, warp tension, and loom functions.

The sequential operation of the air jet loom controlling system may best understood by a review of FIG. 3. There is illustrated a flow chart showing the interrelationship between and the functional operations of the controller, temples, feeders, nozzle pressure, take-up speed, warp tension, and loom functions.

Accordingly, in the preferred embodiment, the yardage of each of the cloth lengths 70 is first entered in the PLC 40. The PLC 40 compares this value with the yardage measurement 46 received from compressor 16 and a predetermined value to determine whether the tabby should be inserted or not. If not necessary, PLC 40 provides a stop loom signal to the operator 74. Otherwise, the controller 40 compares the value of the tabby to the value set for the tabby length 76. At this point, the PLC 40 provides control signals which engage the temples 80; changes the feeders 82; changes the relay nozzle pressure 84; changes the main nozzle pressure 86; changes pick spacings 90; changes the warp tension 92; changes the air value timing 94; and changes the feeder firing position 96 to that of the higher density woven cloth for the tabby.

The PLC 40 then monitors the pick count value to determine when the end of the tabby 100 has been reached and decides 102 whether this an intermediate tabby or a final tabby. If it is a final tabby, the PLC 40 provides a signal 104 to stop the loom and signal the operator. If it is an intermediate tabby, the PLC 40 proceeds to the second yardage value 70 back to the beginning of the flow chart.

Figure 4:
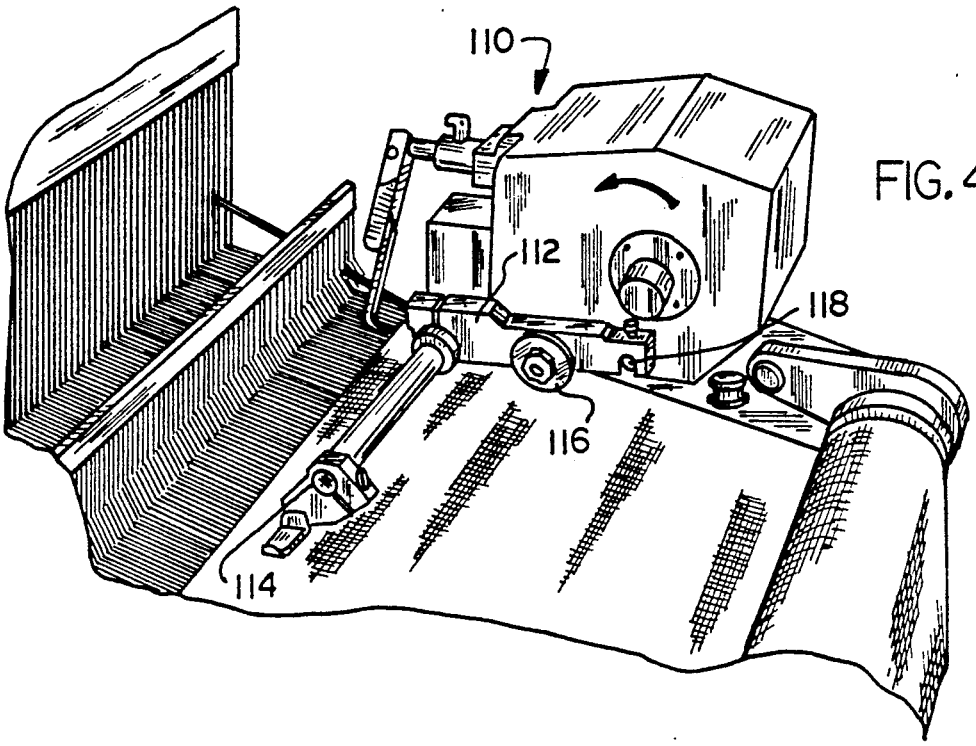
FIG. 4 is a side elevational view of a prior art manual temple insertion device.

Heretofore, one reason it was not possible to preprogram an entire creel was because it was necessary that the operator manually intervened to set the temple insert devices or that the tabby could be woven. An example of a conventional, manually operated, prior art temple insert device, generally designated in 110, is shown in FIG. 4. Temple insert device 110 includes a lever arm 112 which is attached to the temple support bracket 114. Lever arm 112 is pivotable about pivot point 116 from the engaged position to a disengaged position. The end of lever arm 112 opposite from temple bracket 114 may be provided with a stop 118 to ensure proper positioning of the manual trip temple insertion device. However, there is no means for automatically engaging and disengaging the temple insertion device.

Figure 5:
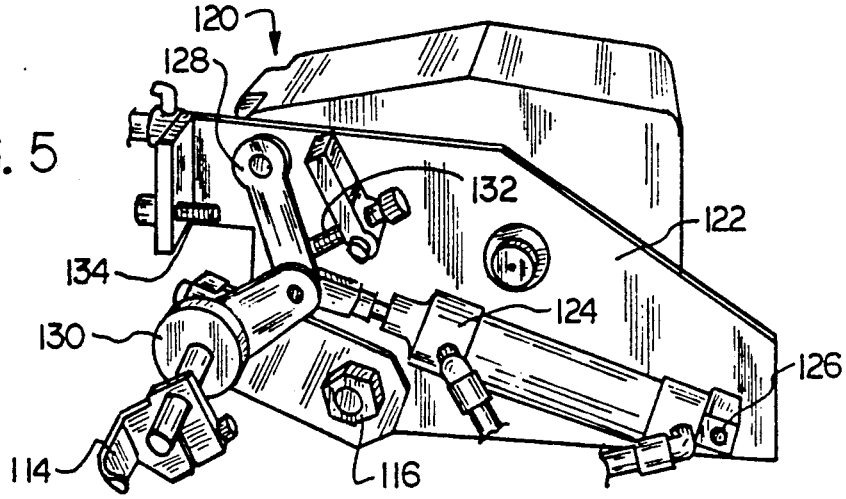
FIG. 5 is a side elevational view of an automatic temple insertion device, constructed according to the present invention, in its disengaged position.

As best seen in FIG. 5, there is shown a side elevation view of an automatic temple actuator, generally designated 120, constructed according to the present invention. The automatic temple actuator 120, includes a mounting base 122 which may be attached to the existing selvage tucker of the air jet loom. A two way air cylinder 124 is attached at one end to the mounting base 122 and at the other end to a bi-stable lever arm 128. One end of the bi-stable lever arm 128 is attached to the mounting base 122 and the other end is attached by means of a bearing 130 to the existing lever arm 112 adjacent to the temple bracket 114. A pair of adjustable stops 132, 134 are attached to the mounting base 122 on either side of the bi-stable lever 128.

Figure 6:
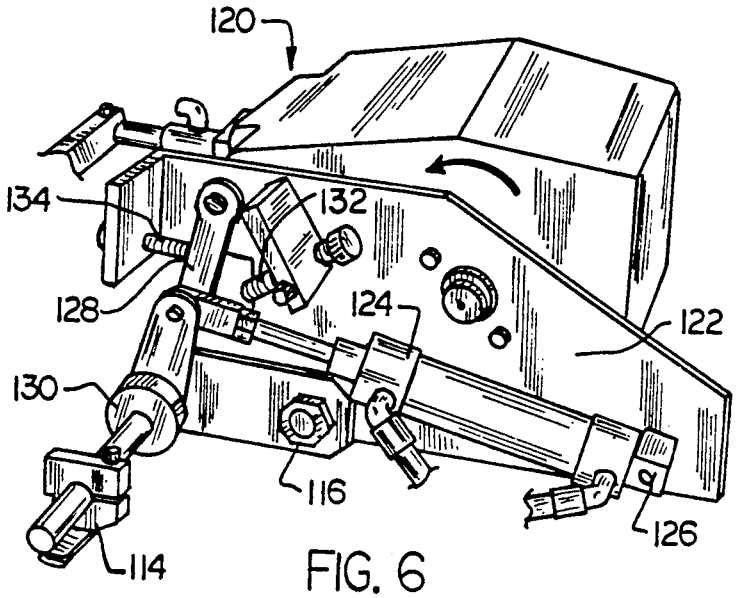
FIG. 6 is a side elevational view of the automatic temple insertion device, as shown in FIG. 5, in its engaged position.

Finally, FIG. 6 illustrates a side elevational view of the automatic temple insertion device, shown in FIG. 5, in its engaged position. As best seen in FIG. 6, when the air pressure to cylinder 124 is reversed the plunger of cylinder 124 extends causing bi-stable lever 128 to move forward and engage adjustable stop 134. This action increases the effective length of the bi-stable lever 128, thereby depressing lever arm 112 and causing temple bracket 114 to be lowered and engage the fabric. Similarly, as shown in FIG. 5, when the air pressure is reversed bi-stable lever 128 returns against adjustable stop 132 causing the effective length of lever arm of 128 to be shortened, thereby raising lever arm 112 to disengage the temple. Any of a number of conventional air cylinders can be used for the present invention, however a Clippard model UDR-17-15, manufactured by Clippard Manufacturing of Cincinnati, Ohio and having a 3-inch stroke and operated at 90 PSI has been found particularly suitable.

Certain modifications and improvements will occur to those skilled in the art upon reading of the foregoing description. By way of example, other mechanisms including hydraulic, electro-mechanical, and gear driven arrangements could be used to insert the loom temples. Also, the relative positions of the temple and fell support could be reversed. It should be understood that all such modifications and improvements have been deleted herein for the sake of conciseness and readability but are properly within the scope of the following claims.

We claim:

1. An apparatus for a power loom for automatically varying the pick density of a woven fabric produced by said loom between a first density value to a second, substantially different density value, said apparatus comprising:

(a) first means associated with said loom for supplying a fill yarn having a first predetermined denier value suitable for forming the portion of said woven fabric corresponding to said first density value;

(b) means associated with said loom for adjusting the pick density of said woven fabric;

(c) temple means for holding said woven fabric at a predetermined width, said temple means being selectively operable between a first position out of engagement with said woven fabric and a second position in engagement with said woven fabric; and (d) control means connected to said first means for supplying a fill yarn, said means associated with said loom, and said temple means, said control means being operable to selectively engage said temple means and to permit sad loom to vary the pick density of said woven fabric while maintaining said woven fabric at a predetermined width without operator intervention.

2. The apparatus according to claim 1, further including means for feeding a plurality of yarn ends to said loom under constant tension and providing a control signal to said control means representative of the yardage received by said loom whereby said control means is responsive to a predetermined yardage value.

3. The apparatus according to claim 1, further including second means associated with said loom for supplying a fill yarn having a second predetermined denier value suitable for forming the portion of said woven fabric corresponding to said second density value.

4. The apparatus according to claim 3, wherein said second means for supplying a fill yarn having the second predetermined denier value is operable at a second air pressure value.

5. The apparatus according to claim 4, wherein said second air pressure value is less than said first air pressure value.

6. The apparatus according to claim 1, wherein said means associated with said loom for adjusting the pick density of said woven fabric includes a take-up roll.

7. The apparatus according to claim 1, wherein said means associated with said loom for adjusting the pick density of said woven fabric further includes means for adjusting the warp tension.

8. The apparatus according to claim 1, wherein said first means for supplying a fill yarn having the first predetermined denier value is operable at a first air pressure value.

9. An apparatus for automatically inserting a temple for holding woven fabric in a loom at a predetermined width, said apparatus comprising:

(a) a support plate attached to one side of said loom adjacent to the edge of said woven fabric;

(b) a bracket pivotally attached at one end to said support plate and attached to said temple at the other end; and (c) actuator means attached at one end to said support plate and at the other end to said bracket, whereby said temple is selectively operable between a first position out of engagement with the woven fabric and a second position in engagement with the woven fabric, wherein said actuator means includes a pair of upper and lower linkage arms, said lower arm attached at one end to said bracket near the end of said bracket adjacent to said support plate, said upper arm pivotable attached to said support plate, and the other end of each of said arms pivotally attached to one another to form a flexible joint and further including a first stop means attached to said support plate adjacent to said upper linkage arm for limiting the forward movement thereof.

10. The apparatus according to claim 9, wherein said actuator means further includes a pneumatic cylinder attached between said flexible joint and said support plate.

11. The apparatus according to claim 9, further including a second stop means attached to said support plate adjacent to said upper linkage arm for limiting the rearward movement thereof.

12. A weaving apparatus for automatically forming intermediate tabby sections in a continuous length of woven fabric on a power loom comprising:

(a) first means associated with said loom for supplying a fill yarn having a first predetermined denier value;

(b) second means associated with said loom for supplying a fill yarn having a second predetermined denier value;

(c) take-up roll means associated with said loom for adjusting the pick density of said woven fabric;

(d) temple means for holding said woven fabric at a predetermined width, said temple means including (i) a support plate attached to one side of said loom adjacent to the edge of said woven fabric; (ii) a bracket pivotally attached at one end to said support plate and attached to said temple at the other end; and (iii) actuator means attached at one end to said support plate and at the other end to said bracket, said temple means being selectively operable between a first position out of engagement with said woven fabric and a second position in engagement with said woven fabric; and (e) control means connected to said first and second means for supplying fill yarn, said take-up roll means, and said temple means, said control means being operable to selectively engage said temple means and to permit said loom to vary the pick density of said woven fabric while maintaining said woven fabric at a predetermined width without operator intervention.

13. The apparatus according to claim 12, further including means for feeding a plurality of yarn ends to said loom under constant tension.

14. The apparatus according to claim 13, further including means for providing a control signal to said control means representative of the yardage received by said loom whereby said control means is responsive to a predetermined yardage value.

15. The apparatus according to claim 12, wherein said actuator means includes a pair of upper and lower linkage arms, said lower arm attached at one end to said bracket near the end of said bracket adjacent to said support plate, said upper arm pivotable attached to said support plate, and the other end of each of said arms pivotally attached to one another to form a flexible joint.

16. The apparatus according to claim 15, wherein said actuator means further includes a pneumatic cylinder attached between said flexible joint and said support plate.

17. The apparatus according to claim 15, further including a first stop means attached to said support plate adjacent to said upper linkage arm for limiting the forward movement thereof.

18. The apparatus according to claim 17, further including a second stop means attached to said support plate adjacent to said upper linkage arm for limiting the rearward movement thereof.

* * * * *